US005765642A

United States Patent [19]

Surjaatmadja

[11] Patent Number: 5,765,642

[45] Date of Patent: Jun. 16, 1998

[54] SUBTERRANEAN FORMATION FRACTURING METHODS

[75] Inventor: Jim B. Surjaatmadja, Duncan, Okla.

[73] Assignee: Halliburton Energy Services, Inc., Duncan, Okla.

[21] Appl. No.: 774,125

[22] Filed: Dec. 23, 1996

[51] Int. Cl.[6] ..... E21B 43/114; E21B 43/26; E21B 43/27

[52] U.S. Cl. ..... 166/297; 166/50; 166/177.5; 166/307; 166/308; 299/17

[58] Field of Search ..... 166/50, 222, 223, 166/177.5, 250.1, 280, 307, 308, 325, 297; 175/67; 405/55, 58, 73; 299/17

[56] References Cited

U.S. PATENT DOCUMENTS

| | | | |
|---|---|---|---|
| 4,050,529 | 9/1977 | Tagirov et al. | 166/223 X |
| 4,103,971 | 8/1978 | Denisart et al. | 299/17 |
| 4,479,541 | 10/1984 | Wang | 166/50 X |
| 4,529,036 | 7/1985 | Daneshy et al. | 166/254 |
| 4,880,059 | 11/1989 | Brandell et al. | 166/332 |
| 4,919,204 | 4/1990 | Baker et al. | 166/223 |
| 4,974,675 | 12/1990 | Austin et al. | 166/250 |
| 5,111,881 | 5/1992 | Soliman et al. | 166/250 |
| 5,249,628 | 10/1993 | Surjaatmadja | 166/308 |
| 5,325,923 | 7/1994 | Surjaatmadja et al. | 166/308 |
| 5,335,724 | 8/1994 | Venditto et al. | 166/298 |
| 5,363,927 | 11/1994 | Frank | 175/67 |
| 5,396,957 | 3/1995 | Surjaatmadja et al. | 166/308 |
| 5,499,678 | 3/1996 | Surjaatmadja | 166/308 X |

*Primary Examiner*—George A. Suchfield

*Attorney, Agent, or Firm*—Stephen R. Christian; C. Clark Dougherty, Jr.

[57] ABSTRACT

Methods of fracturing subterranean formations are provided. The methods basically comprise positioning a hydrajetting tool having at least one fluid jet forming nozzle in the well bore adjacent the formation to be fractured and jetting fluid through the nozzle against the formation at a pressure sufficient to form a fracture in the formation.

20 Claims, 2 Drawing Sheets

SUBTERRANEAN FORMATION FRACTURING METHODS

BACKGROUND OF THE INVENTION

1. Field of the Invention

The present invention relates to improved methods of fracturing subterranean formations to stimulate the production of desired fluids therefrom.

2. Description of the Prior Art

Hydraulic fracturing is often utilized to stimulate the production of hydrocarbons from subterranean formations penetrated by well bores. In performing hydraulic fracturing treatments, a portion of a formation to be fractured is isolated using conventional packers or the like, and a fracturing fluid is pumped through the well bore into the isolated portion of the formation to be stimulated at a rate and pressure such that fractures are formed and extended in the formation. Propping agent is suspended in the fracturing fluid which is deposited in the fractures. The propping agent functions to prevent the fractures from closing and thereby provide conductive channels in the formation through which produced fluids can readily flow to the well bore.

In wells penetrating medium permeability formations, and particularly those which are completed open hole, it is often desirable to create fractures in the formations near the well bores in order to improve hydrocarbon production from the formations. As mentioned above, to create such fractures in formations penetrated by cased or open hole well bores conventionally, a sealing mechanism such as one or more packers must be utilized to isolate the portion of the subterranean formation to be fractured. When used in open hole well bores, such sealing mechanisms are often incapable of containing the fracturing fluid utilized at the required fracturing pressure. Even when the sealing mechanisms are capable of isolating a formation to be fractured penetrated by either a cased or open hole well bore, the use and installation of the sealing mechanisms are time consuming and add considerable expense to the fracturing treatment.

Thus, there is a need for improved methods of creating fractures in subterranean formations to improve hydrocarbon production therefrom which are relatively simple and inexpensive to perform.

SUMMARY OF THE INVENTION

The present invention provides improved methods of fracturing a subterranean formation penetrated by a well bore which do not require the mechanical isolation of the formation and meet the needs described above. The improved methods of this invention basically comprise the steps of positioning a hydrajetting tool having at least one fluid jet forming nozzle in the well bore adjacent the formation to be fractured, and then jetting fluid through the nozzle against the formation at a pressure sufficient to form a cavity therein and fracture the formation by stagnation pressure in the cavity.

The jetted fluid can include a particulate propping agent which is deposited in the fracture as the jetting pressure of the fluid is slowly reduced and the fracture is allowed to close. In addition, the fracturing fluid can include one or more acids to dissolve formation materials and enlarge the formed fracture.

The hydrajetting tool utilized preferably includes a plurality of fluid jet forming nozzles. Most preferably, the nozzles are disposed in a single plane which is aligned with the plane of maximum principal stress in the formation to be fractured. Such alignment generally results in the formation of a single fracture extending outwardly from and around the well bore. When the fluid jet forming nozzles are not aligned with the plane of maximum principal stress in the formation, each nozzle creates a single fracture.

The fractures created by the hydrajetting tool can be extended further into the formation in accordance with the present invention by pumping a fluid into the annulus between tubing or a work string attached to the hydrajetting tool and the well bore to raise the ambient fluid pressure exerted on the formation while the formation is being fractured by the fluid jets produced by the hydrajetting tool.

It is, therefore, a general object of the present invention to provide improved methods of fracturing subterranean formations penetrated by well bores.

Other and further objects, features and advantages of the present invention will be readily apparent from the description of preferred embodiments which follows when taken in conjunction with the accompanying drawings.

DESCRIPTION OF PREFERRED EMBODIMENTS

As mentioned above, in wells penetrating medium permeability formations, and particularly deviated wells which are completed open hole, it is often desirable to create relatively small fractures referred to in the art as "microfractures" in the formations near the well bores to improve hydrocarbon production therefrom. In accordance with the present invention, such microfractures are formed in subterranean well formations utilizing a hydrajetting tool having at least one fluid jet forming nozzle. The tool is positioned adjacent to a formation to be fractured, and fluid is then jetted through the nozzle against the formation at a pressure sufficient to form a cavity therein and fracture the formation by stagnation pressure in the cavity. A high stagnation pressure is produced at the tip of a cavity in a formation being jetted because of the jetted fluids being trapped in the cavity as a result of having to flow out of the cavity in a direction generally opposite to the direction of the incoming jetted fluid. The high pressure exerted on the formation at the tip of the cavity causes a microfracture to be formed and extended a short distance into the formation.

In order to extend a microfracture formed as described above further into the formation in accordance with this invention, a fluid is pumped from the surface into the well bore to raise the ambient fluid pressure exerted on the formation while the formation is being fractured by the fluid jet or jets produced by the hydrajetting tool. The fluid in the well bore flows into the cavity produced by the fluid jet and flows into the fracture at a rate and high pressure sufficient to extend the fracture an additional distance from the well bore into the formation.

Figure 1:
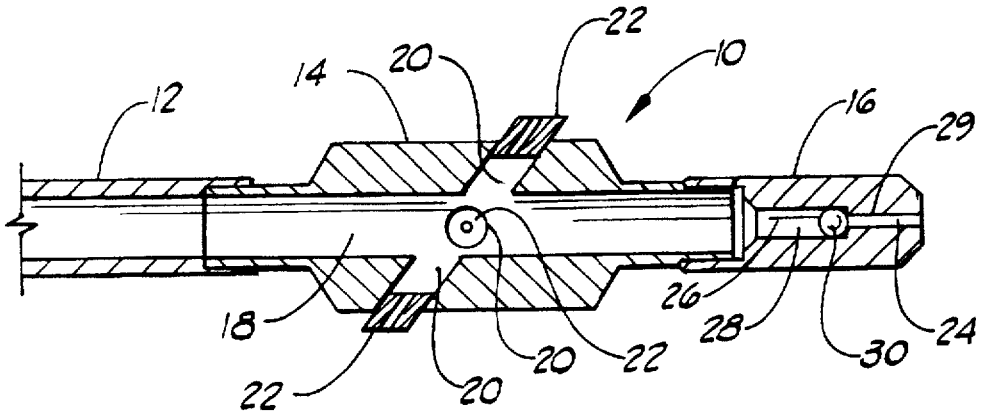
FIG. 1 is a side elevational view of a hydrajetting tool assembly which can be utilized in accordance with the present invention.

Referring now to FIG. 1, a hydrajetting tool assembly for use in accordance with the present invention is illustrated and generally designated by the numeral 10. The tool assembly 10 is shown threadedly connected to a work string 12 through which a fluid is pumped at a high pressure. In a preferred arrangement as shown in FIG. 1, the tool assembly 10 is comprised of a tubular hydrajetting tool 14 and a tubular, ball activated, check valve member 16.

The hydrajetting tool 14 includes an axial fluid flow passageway 18 extending therethrough and communicating with at least one and preferably as many as feasible, angularly spaced lateral ports 20 disposed through the sides of the tool 14. A fluid jet forming nozzle 22 is connected within each of the ports 20. As will be described further hereinbelow, the fluid jet forming nozzles 22 are preferably disposed in a single plane which is positioned at a predetermined orientation with respect to the longitudinal axis of the tool 14. Such orientation of the plane of the nozzles 22 coincides with the orientation of the plane of maximum principal stress in the formation to be fractured relative to the longitudinal axis of the well bore penetrating the formation.

The tubular, ball activated, check valve 16 is threadedly connected to the end of the hydrajetting tool 14 opposite from the work string 12 and includes a longitudinal flow passageway 26 extending therethrough. The longitudinal passageway 26 is comprised of a relatively small diameter longitudinal bore 24 through the exterior end portion of the valve member 16 and a larger diameter counter bore 28 through the forward portion of the valve member which forms an annular seating surface 29 in the valve member for receiving a ball 30 (FIG. 1). As will be understood by those skilled in the art, prior to when the ball 30 is dropped into the tubular check valve member 16 as shown in FIG. 1, fluid freely flows through the hydrajetting tool 14 and the check valve member 16. After the ball 30 is seated on the seat 29 in the check valve member 16 as illustrated in FIG. 1, flow through the check valve member 16 is terminated which causes all of the fluid pumped into the work string 12 and into the hydrajetting tool 14 to exit the hydrajetting tool 14 by way of the fluid jet forming nozzles 22 thereof. When it is desired to reverse circulate fluids through the check valve member 16, the hydrajetting tool 14 and the work string 12, the fluid pressure exerted within the work string 12 is reduced whereby higher pressure fluid surrounding the hydrajetting tool 14 and check valve member 16 freely flows through the check valve member 16, causing the ball 30 to be pushed out of engagement with the seat 29, and through the nozzles 22 into and through the work string 12.

Figure 2:
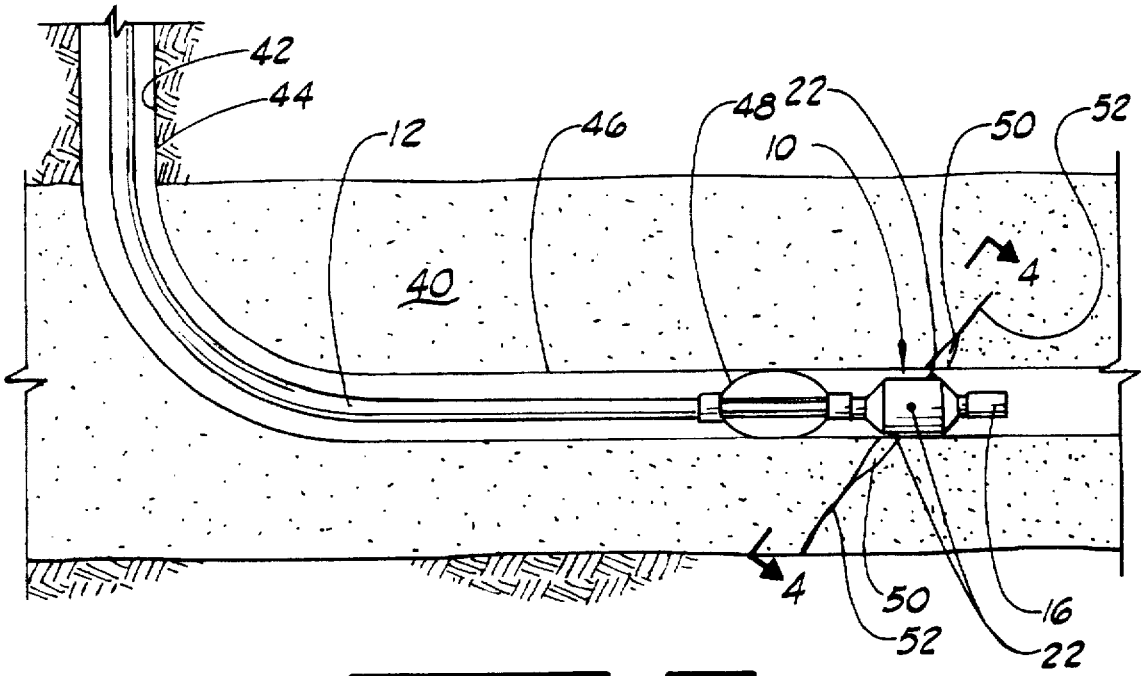
FIG. 2 is a side cross sectional partial view of a deviated open hole well bore having the hydrajetting tool assembly of FIG. 1 along with a conventional centralizer disposed in the well bore and connected to a work string.

Referring now to FIG. 2, a hydrocarbon producing subterranean formation 40 is illustrated penetrated by a deviated open hole well bore 42. The deviated well bore 42 includes a substantially vertical portion 44 which extends to the surface, and a substantially horizontal portion 46 which extends into the formation 40. The work string 12 having the tool assembly 10 and an optional conventional centralizer 48 attached thereto is shown disposed in the well bore 42.

Prior to running the tool assembly 10, the centralizer 48 and the work string 12 into the well bore 42, the orientation of the plane of maximum principal stress in the formation 40 to be fractured with respect to the longitudinal direction of the well bore 42 is preferably determined utilizing known information or conventional and well known techniques and tools. Thereafter, the hydrajetting tool 14 to be used to perform fractures in the formation 42 is selected having the fluid jet forming nozzles 22 disposed in a plane which is oriented with respect to the longitudinal axis of the hydrajetting tool 14 in a manner whereby the plane containing the fluid jet nozzles 22 can be aligned with the plane of the maximum principal stress in the formation 40 when the hydrajetting tool 14 is positioned in the well bore 42. As is well understood in the art, when the fluid jet forming nozzles 22 are aligned in the plane of the maximum principal stress in the formation 40 to be fractured and a fracture is formed therein, a single microfracture extending outwardly from and around the well bore 42 in the plane of maximum principal stress is formed. Such a single fracture is generally preferred in accordance with the present invention. However, when the fluid jet forming nozzles 22 of the hydrajetting tool 14 are not aligned with the plane of maximum principal stress in the formation 40, each fluid jet forms an individual cavity and fracture in the formation 42 which in some circumstances may be preferred.

Figure 4:
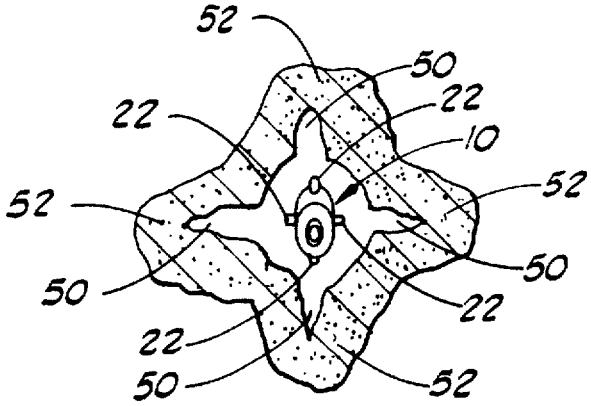
FIG. 4 is a cross sectional view taken along line 4—4 of FIG. 2.

Once the hydrajetting tool assembly 10 has been positioned in the well bore 42 adjacent to the formation to be fractured 40, a fluid is pumped through the work string 12 and through the hydrajetting tool assembly 10 whereby the fluid flows through the open check valve member 16 and circulates through the well bore 42. The circulation is preferably continued for a period of time sufficient to clean out debris, pipe dope and other materials from inside the work string 12 and from the well bore 42. Thereafter, the ball 30 is dropped through the work string 12, through the hydrajetting tool 14 and into the check valve member 16 while continuously pumping fluid through the work string 12 and the hydrajetting tool assembly 10. When the ball 30 seats on the annular seating surface 29 in the check valve member 16 of the assembly 10, all of the fluid is forced through the fluid jet forming nozzles 22 of the hydrajetting tool 14. The rate of pumping the fluid into the work string 12 and through the hydrajetting tool 14 is increased to a level whereby the pressure of the fluid which is jetted through the nozzles 22 reaches that jetting pressure sufficient to cause the creation of the cavities 50 and microfractures 52 in the subterranean formation 40 as illustrated in FIGS. 2 and 4.

A variety of fluids can be utilized in accordance with the present invention for forming fractures including drilling fluids and aqueous fluids. Various additives can also be included in the fluids utilized such as abrasives, fracture propping agent, e.g., sand, acid to dissolve formation materials and other additives known to those skilled in the art.

As will be described further hereinbelow, the jet differential pressure at which the fluid must be jetted from the nozzles 22 of the hydrajetting tool 14 to result in the formation of the cavities 50 and microfractures 52 in the formation 40 is a pressure of approximately two times the pressure required to initiate a fracture in the formation less the ambient pressure in the well bore adjacent to the formation. The pressure required to initiate a fracture in a particular formation is dependent upon the particular type of rock and/or other materials forming the formation and other factors known to those skilled in the art. Generally, after a well bore is drilled into a formation, the fracture initiation pressure can be determined based on information gained during drilling and other known information. Since well bores are filled with drilling fluid or other fluid during fracture treatments, the ambient pressure in the well bore adjacent to the formation being fractured is the hydrostatic pressure exerted on the formation by the fluid in the well bore. When fluid is pumped into the well bore to increase the pressure to a level above hydrostatic to extend the microfractures as will be described further hereinbelow, the ambient pressure is whatever pressure is exerted in the well bore on the walls of the formation to be fractured as a result of the pumping.

In carrying out the methods of the present invention for forming a series of microfractures in a subterranean formation, the hydrajetting tool assembly 10 is positioned in the well bore 42 adjacent the formation to be fractured as shown in FIG. 2. As indicated above, the work string 12 and tool assembly 10 are cleaned by circulating fluid through the work string 12 and tool assembly 10 and upwardly through the well bore 42 for a period of time. After such circulation, the ball 30 is dropped into the tool assembly 10 and fluid is jetted through the nozzles 22 of the hydrajetting tool 14 against the formation at a pressure sufficient to form a cavity therein and fracture the formation by stagnation pressure in the cavity. Thereafter, the tool assembly 10 is moved to different positions in the formation and the fluid is jetted against the formation at those positions whereby successive fractures are formed in the formation.

When the well bore 42 is deviated (including horizontal) as illustrated in FIG. 2, the centralizer 48 is utilized with the tool assembly 10 to insure that each of the nozzles 22 has a proper stand off clearance from the walls of the well bore 42, i.e., a stand off clearance in the range of from about ¼ inch to about 2 inches.

At a stand off clearance of about 1.5 inches between the face of the nozzles 22 and the walls of the well bore and when the fluid jets formed flare outwardly at their cores at an angle of about 20°, the jet differential pressure required to form the cavities 50 and the microfractures 52 is a pressure of about 2 times the pressure required to initiate a fracture in the formation less the ambient pressure in the well bore adjacent to the formation. When the stand off clearance and degree of flare of the fluid jets are different from those given above, the following formulas can be utilized to calculate the jetting pressure.

$$Pi=Pf-Ph$$

$$\Delta P/Pi=1.1[d+(s+0.5)\tan(\text{flare})]^2/d^2$$

wherein;

Pi=difference between formation fracture pressure and ambient pressure, psi

Pf=formation fracture pressure, psi

Ph=ambient pressure, psi

ΔP=the jet differential pressure, psi d=diameter of the jet, inches s =stand off clearance, inches flare=flaring angle of jet, degrees As mentioned above, propping agent is combined with the fluid being jetted so that it is carried into the cavities 50 as well as at least partially into the microfractures 52 connected to the cavities. The propping agent functions to prop open the microfractures 52 when they are closed as a result of the termination of the hydrajetting process. In order to insure that propping agent remains in the fractures when they close, the jetting pressure is preferably slowly reduced to allow the fractures to close on propping agent which is held in the fractures by the fluid jetting during the closure process. In addition to propping the fractures open, the presence of the propping agent, e.g., sand, in the fluid being jetted facilitates the cutting and erosion of the formation by the fluid jets. As indicated, additional abrasive material can be included in the fluid as can one or more acids which react with and dissolve formation materials to enlarge the cavities and fractures as they are formed. Once one or more microfractures are formed as a result of the above procedure, the hydrajetting assembly 10 is moved to a different position and the hydrajetting procedure is repeated to form one or more additional microfractures which are spaced a distance from the initial microfracture or microfractures.

Figure 3:
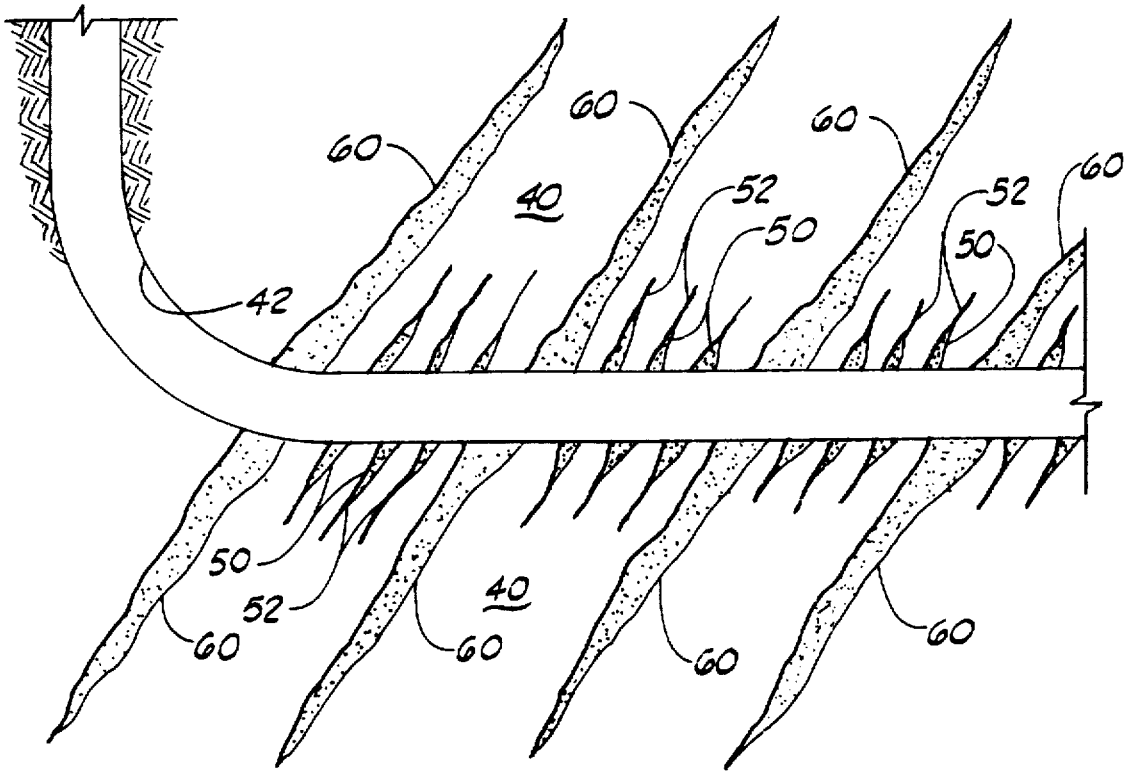
FIG. 3 is a side cross sectional view of the deviated well bore of FIG. 2 after a plurality of microfractures and extended fractures have been created therein in accordance with the present invention.

As mentioned above, some or all of the microfractures produced in a subterranean formation can be extended into the formation by pumping a fluid into the well bore to raise the ambient pressure therein. That is, in carrying out the methods of the present invention to form and extend a fracture in the present invention, the hydrajetting assembly 10 is positioned in the well bore 42 adjacent the formation 40 to be fractured and fluid is jetted through the nozzles 22 against the formation 40 at a jetting pressure sufficient to form the cavities 50 and the microfractures 52. Simultaneously with the hydrajetting of the formation, a fluid is pumped into the well bore 42 at a rate to raise the ambient pressure in the well bore adjacent the formation to a level such that the cavities 50 and microfractures 52 are enlarged and extended whereby enlarged and extended fractures 60 (FIG. 3) are formed. As shown in FIG. 3, the enlarged and extended fractures 60 are preferably formed in spaced relationship along the well bore 42 with groups of the cavities 50 and microfractures 52 formed therebetween.

EXAMPLE

A deviated well comprised of 12,000 feet of vertical well bore containing 7.625 inch casing and 100' of horizontal open hole well bore in a hydrocarbon producing formation is fractured in accordance with the present invention. The fracture initiation pressure of the formation is 9,000 psi and the ambient pressure in the well bore adjacent the formation is 5765 psi.

The stand off clearance of the jet forming nozzles of the hydrajetting tool used is 1.5 inches and the flare of the jets is 2 degrees. The fracturing fluid is a gelled aqueous liquid-nitrogen foam having a density of 8.4 lbs/gal. The required differential pressure of the jets is calculated to be 6,740 psi based on two times the formation fracture pressure less the hydrostatic pressure [2×(9,000 psi−5,765 psi)=6,740 psi].

The formation is fractured using 14,000 feet of 2 inch coiled tubing and a 2 inch I.D. hydrajetting tool having three angularly spaced 0.1875 inch I.D. jet forming nozzles disposed in a single plane which is aligned with the plane of maximum principal stress in the formation. The average surface pumping rate of fracturing fluid utilized is 5.23 barrels per minute and the average surface pump pressure is 7,725 psi. In addition, from about 5 to about 10 barrels per minute of fluid can be pumped into the annulus between the coiled tubing and the well bore to create a larger fracture.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. A method of fracturing a subterranean formation penetrated by a well bore comprising the steps of:

(a) positioning a hydrajetting tool having at least one fluid jet forming nozzle in said well bore adjacent to said formation to be fractured; and (b) jetting fluid through said nozzle against said formation at a pressure sufficient to form a cavity in the formation that is in fluid communication with the wellbore and further jetting fluid through said nozzle to fracture the formation by stagnation pressure in the cavity while maintaining said fluid communication.

2. The method of claim 1 wherein the jetting pressure utilized in accordance with step (b) is a pressure of about two times the pressure required to initiate a fracture in said formation less the ambient pressure in said well bore adjacent to said formation.

3. The method of claim 1 which further comprises the step of aligning said fluid jet forming nozzle of said tool with the plane of maximum principal stress in said formation.

4. The method of claim 1 wherein said hydrajetting tool includes a plurality of fluid jet forming nozzles.

5. The method of claim 4 wherein said fluid jet forming nozzles are disposed in a single plane.

6. The method of claim 5 which further comprises the step of aligning said plane of said fluid jet forming nozzles with the plane of maximum principal stress in said formation.

7. The method of claim 1 wherein said fluid jetted through said nozzle contains a particulate propping agent.

8. The method of claim 7 wherein said propping agent is sand.

9. The method of claim 8 which further comprises the step of slowly reducing the jetting pressure of said fluid to thereby allow said fracture in said formation to close on said propping agent.

10. The method of claim 1 wherein said fluid is an aqueous fluid.

11. The method of claim 1 wherein said fluid is an aqueous acid solution.

12. A method of fracturing a subterranean formation penetrated by a well bore comprising the steps of:

(a) positioning a hydrajetting tool having at least one fluid jet forming nozzle in said well bore adjacent to said formation to be fractured;

(b) jetting a fluid through said nozzle against said formation at a pressure sufficient to form a fracture in said formation; and (c) pumping a fluid into said well bore at a rate to raise the ambient pressure in the annulus between said formation to a level sufficient to extend said fracture into said formation.

13. The method of claim 12 which further comprises the steps of:

(d) moving said hydrajetting tool to a different position in said formation; and (e) repeating steps (a) through (c).

14. The method of claim 12 which further comprises the step of aligning said fluid jet forming nozzle of said tool with the plane of maximum principal stress in said formation.

15. The method of claim 12 wherein said hydrajetting tool includes a plurality of fluid jet forming nozzles.

16. The method of claim 15 wherein said fluid jet forming nozzles are disposed in a single plane.

17. The method of claim 16 which further comprises the step of aligning said plane of said fluid jet forming nozzles with the plane of maximum principal stress in said formation.

18. The method of claim 17 wherein said fluid jetted through said nozzle contains a particulate propping agent.

19. The method of claim 18 wherein said fluid is an aqueous fluid.

20. The method of claim 19 wherein said fluid is an aqueous acid solution.

* * * * *

US005765642C1

(12) EX PARTE REEXAMINATION CERTIFICATE (5516th)

United States Patent

Surjaatmadja

(10) Number: US 5,765,642 C1

(45) Certificate Issued: Sep. 19, 2006

(54) SUBTERRANEAN FORMATION FRACTURING METHODS

(75) Inventor: Jim B. Surjaatmadja, Duncan, OK (US)

(73) Assignee: Halliburton Energy Services, Inc., Duncan, OK (US)

Reexamination Request:
No. 90/007,596, Jun. 20, 2005

Reexamination Certificate for:

| | |
|---|---|
| Patent No.: | **5,765,642** |
| Issued: | **Jun. 16, 1998** |
| Appl. No.: | **08/774,125** |
| Filed: | **Dec. 23, 1996** |

(51) Int. Cl.

| | |
|---|---|
| ***E21B 43/11*** | (2006.01) |
| ***E21B 43/114*** | (2006.01) |
| ***E21B 43/26*** | (2006.01) |
| ***E21B 43/25*** | (2006.01) |

(52) U.S. Cl. ..... 166/297; 166/177.5; 166/307; 166/308.1; 166/50; 299/17

(58) Field of Classification Search ..... None
See application file for complete search history.

(56) References Cited

PUBLICATIONS

J.B. Surjaatmadja, H.H. Abass and J.L. Brumley, Elimination of Near–Wellbore Tortuosities by Means of Hydrojetting, Society of Petroleum Engineers, SPE 28761—presentation of the 1994 Asia Pacific Oil & Gas Conference, Melbourne, Australia, Nov. 7–10, 1994.

Robert Wade Brown and Jack L. Loper, Theory of Formation Cutting Using the Sand Erosion Process, Society of Petroleum Engineers—presented at the 35$^{th}$ Annual Fall Meeting of SPE, Oct. 2–5, 1960 in Denver, CO.

H.H. Abass, Saeed Hedayati and D.L. Meadows, Nonplanar Fracture Propagation From a Horizontal Wellbore: Experimental Study, Society of Petroleum Engineers, SPE 24823, presented a the 1992 SPE Annual Technical Conference and Exhibition held in Washington, D.C., Oct. 4–7, 1992.

*Primary Examiner*—David O. Reip

(57) ABSTRACT

Methods of fracturing subterranean formations are provided. The methods basically comprise positioning a hydrajetting tool having at least one fluid jet forming nozzle in the well bore adjacent the formation to be fractured and jetting fluid through the nozzle against the formation at a pressure sufficient to form a fracture in the formation.

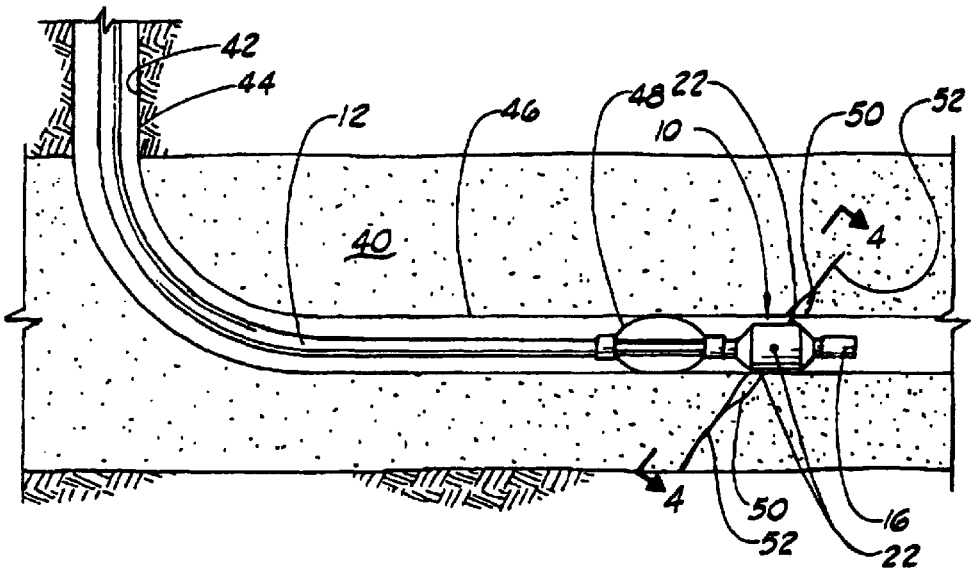

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *

US005765642C2

(12) EX PARTE REEXAMINATION CERTIFICATE (8375th)

United States Patent

Surjaatmadja

(10) Number: US 5,765,642 C2

(45) Certificate Issued: Jun. 28, 2011

(54) SUBTERRANEAN FORMATION FRACTURING METHODS

(75) Inventor: Jim B. Surjaatmadja, Duncan, OK (US)

(73) Assignee: Halliburton Energy Services, Inc., Duncan, OK (US)

Reexamination Request:
No. 90/010,982, May 6, 2010

Reexamination Certificate for:

| | |
|---|---|
| Patent No.: | **5,765,642** |
| Issued: | **Jun. 16, 1998** |
| Appl. No.: | **08/774,125** |
| Filed: | **Dec. 23, 1996** |

Reexamination Certificate C1 5,765,642 issued Sep. 19, 2006

(51) Int. Cl.

| | |
|---|---|
| ***E21B 43/11*** | (2006.01) |
| ***E21B 43/114*** | (2006.01) |
| ***E21B 43/26*** | (2006.01) |
| ***E21B 43/25*** | (2006.01) |

(52) U.S. Cl. ..... 166/297; 166/50; 166/177.5; 166/307; 166/308.1; 299/17

(58) Field of Classification Search ..... None
See application file for complete search history.

(56) References Cited

U.S. PATENT DOCUMENTS

| | | | |
|---|---|---|---|
| 1,241,813 | A | 10/1917 | Bignell |
| 2,228,640 | A | 1/1941 | O'Neill |
| 2,302,567 | A | 11/1942 | O'Neill |
| 2,545,195 | A | 3/1951 | Crake |
| 2,744,361 | A | 5/1956 | Larson et al. |
| 2,758,653 | A | 8/1956 | Desbrow |
| 2,807,443 | A | 9/1957 | Wyman |
| 2,986,214 | A | 5/1961 | Wiseman, Jr. et al. |
| 3,058,521 | A | 10/1962 | Gilbert |
| 3,070,182 | A | 12/1962 | Runte |
| 3,101,051 | A | 8/1963 | Gilbert |
| 3,101,151 | A | 8/1963 | Schreiber |
| 3,130,786 | A | 4/1964 | Brown et al. |
| 3,145,776 | A | 8/1964 | Pittman |
| 3,224,506 | A | 12/1965 | Huitt et al. |
| 3,251,993 | A | 5/1966 | Bader et al. |
| 3,393,736 | A | 7/1968 | Goodwin |
| 3,664,422 | A | 5/1972 | Bullen |
| 3,690,380 | A | 9/1972 | Grable |
| 3,712,379 | A | 1/1973 | Hill |
| 3,823,789 | A | 7/1974 | Garner |
| 3,887,021 | A | 6/1975 | Elbert |
| 4,047,569 | A | 9/1977 | Tagirov et al. |
| 4,050,529 | A | 9/1977 | Tagirov et al. |
| 5,361,856 | A | 11/1994 | Surjaatmadja et al. |
| 5,472,049 | A | 12/1995 | Chaffee et al. |
| 5,494,103 | A | 2/1996 | Surjaatmadja et al. |
| 5,499,678 | A | 3/1996 | Surjaatmadja et al. |
| 5,765,642 | A | 6/1998 | Surjaatmadja |

FOREIGN PATENT DOCUMENTS

| | | |
|---|---|---|
| EP | 0 427 371 B1 | 9/1993 |
| EP | 0 823 538 A2 | 2/1998 |
| RU | SU457792 | 12/1977 |

OTHER PUBLICATIONS

Brown et al., "A New Completion Technique—Sand Erosions," Paper No. 906–5–N presented at Spring Meeting of the Southern Western District of Production, American Petroleum Institute, Mar. 2–4, 1960.

Ousterhout, R. S., "Field Applications of Abrasive–Jetting Techniques," Journal of Petroleum Technology, May 1961, pp. 413–415.

(Continued)

*Primary Examiner*—Beverly M. Flanagan

(57) ABSTRACT

Methods of fracturing subterranean formations are provided. The methods basically comprise positioning a hydrajetting tool having at least one fluid jet forming nozzle in the well bore adjacent the formation to be fractured and jetting fluid through the nozzle against the formation at a pressure sufficient to form a fracture in the formation.

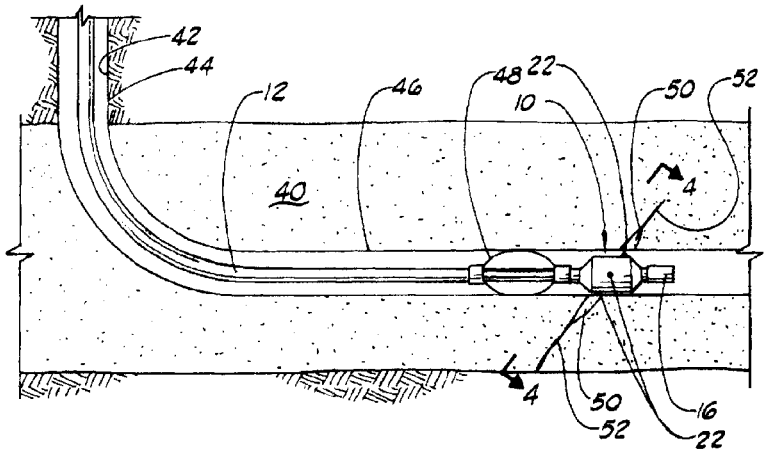

OTHER PUBLICATIONS

Pittman, Forrest C., Harriman, Don W., St. John, James C., "Investigation of Abrasive–Laden–Fluid Method For Perforation and Fracture Initiation," Journal of Petroleum Technology, May 1961, pp. 489–495.

Gilbert, Bruce, "The F. I. Process . . . Theory and Practice," Society of Petroleum Engineers of AIME, Paper presented at the Fourth Annual Joint Meeting of the Rocky Mountain Sections of the American Institute of Mining, Metallurgical and Petroleum Engineers in Denver, Mar. 3–4, 1958.

Bucy, B. J., "Deep Penetration Possible With Hydraulic Perforating," The Western Company, Fort Worth, Texas, reprinted from Drilling Magazine, Feb. 1960.

Widden, Martin, "Fluid Mechanics," Foundations of Engineering Series, MacMillan Press Ltd., Houndmills, Basingstoke, Hampshire, RG21 2XS and London, 1996, pp. 202–204.

Forstall, Walton and Gaylord, E. W., "Momentum and Mass Transfer in a Submerged Water Jet," pp. 161–164, manuscript presented at the Annual Meeting, New York, N. Y., Nov. 28–Dec. 3, 1954, of the American Society of Mechanical Engineers.

Swift, V. N., Jenning, J. W., Bauman, W. E. and Huitt, J. L., "Some Results of Fracturing with the Single–Point Entry Technique," Journal of Petroleum Technology, pp. 29–34, Jan. 1961.

Pekarek, J. L., Lowe, D. K. and Huitt, J. L., "Hydraulic Jetting—Some Theoretical and Experimental Results," Society of Petroleum Engineers Journal, pp. 101–112, Jun. 1963.

Gruesbeck, C. and Collins, R. E., "Particle Transport Through Perforations," SPE 7006, manuscript presented at the Third Symposium on Formation Damage Control of the Society of Petroleum Engineers, in Lafayette, Louisiana, Feb. 15–16, 1978.

Medlin, W. L. and Masse, L., "Laboratory Investigation of Fracture Initiation Pressure and Orientation," Society of Petroleum Engineers Journal, pp. 129–144, Apr. 1979.

Abass, Hazim H., Hagist, Peter, Harry, James, Hunt, James L., Shumway, Mark, Gazi, NAZ, "A Case History of Completing and Fracture Stimulating a Horizontal Well," SPE 29443, presented at 1995 SPE Production Operations Symposium, Oklahoma City, Oklahoma, Apr. 2–4, 1995.

Guo, Genliang and Evans, R. D., "Inflow Performance and Production Forecasting of Horizontal Wells With Multiple Hydraulic Fractures in Low–Permeability Gas Reservoirs," SPE 26169, paper prepared for presentation at the SPE Gas Technology Symposium, Calgary, Alberta, Canada, Jun. 28–30, 1993.

Murdoch, Larry, "Some Recent Developments in Delivery and Recovery: Hydraulic Fracturing and Directional Drilling," in the Proceedings of ETEC'92, the 2nd Annual Environmental Technology Exposition and Conference, Washington, D. C., Apr. 7–9, 1992.

Yost, A. B., II, Overbey, W.K., Jr., Wilkins, D. A., SPE 17759, paper presented at the SPE Gas Technology Symposium, Dallas, Texas, Jun. 13–15, 1988.

Jamaluddin, A.K.M., Vandamme, L. M. and McGuffin, R. G., SPE 26167, paper presented at the SPE Gas Technology Symposium, Calgary, Alberta, Canada, Jun. 28–30, 1993.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *